US008517777B2

(12) United States Patent
Haans et al.

(10) Patent No.: US 8,517,777 B2
(45) Date of Patent: Aug. 27, 2013

(54) ELECTRICALLY CONDUCTIVE MEMBER HAVING A CONTACT PORTION LATERALLY DISPLACED FROM A TERMINAL PORTION

(75) Inventors: Jurgen Haans, Helmond (NL); Jeroen Dittner, S-Hertogenbosch (NL); Wim Jansen, Tilburg (NL)

(73) Assignee: Tyco Electronics Nederland BV, S-Hertogenbosch (NL)

( * ) Notice: Subject to any disclaimer, the term of this patent is extended or adjusted under 35 U.S.C. 154(b) by 0 days.

(21) Appl. No.: 12/932,251

(22) Filed: Feb. 22, 2011

(65) Prior Publication Data

US 2011/0189902 A1 Aug. 4, 2011

(30) Foreign Application Priority Data

Feb. 22, 2010 (EP) ..... 10001766

(51) Int. Cl.
*H01R 4/48* (2006.01)

(52) U.S. Cl.
USPC ..... 439/816

(58) Field of Classification Search
USPC ..... 439/816, 940, 828, 834, 835, 856–857
See application file for complete search history.

(56) References Cited

U.S. PATENT DOCUMENTS 7,510,448 B2 * 3/2009 Eppe et al. ..... 439/835
7,578,712 B2 * 8/2009 Chang ..... 439/816
7,927,158 B2 * 4/2011 Kim et al. ..... 439/816

* cited by examiner

*Primary Examiner* — Chandrika Prasad
(74) *Attorney, Agent, or Firm* — Faegre Baker Daniels LLP

(57) ABSTRACT

The invention relates to an electrically conductive contact member for an electrical connector, comprising a terminal portion adapted to be mechanically and electrically connected to at least one conductor, a contact portion adapted to contact a mating contact portion of a mating connector, a spring portion that electrically connects the terminal portion to the contact portion, the contact portion being supported by the spring portion elastically displaceable from a resting position to a displacement position, and a holding portion that comprises a picking platform for attachment of a pick-up head, wherein the holding portion provides a stop against which, in the resting position, the spring portion is pressed. To improve the mechanical and electrical performance, the spring portion is spaced apart from the picking platform in the displacement position.

17 Claims, 5 Drawing Sheets

ELECTRICALLY CONDUCTIVE MEMBER HAVING A CONTACT PORTION LATERALLY DISPLACED FROM A TERMINAL PORTION

The invention relates to an electrically conductive contact member for an electrical connector, comprising a terminal portion adapted to be mechanically and electrically connected to at least one conductor, a contact portion adapted to contact a mating contact portion of a mating connector, a spring portion that electrically connects the terminal portion to the contact portion, the contact portion being supported by the spring portion elastically displaceable from a resting position to a displacement position, and a holding portion that comprises a picking platform for attachment of a pick-up head, wherein the holding portion provides a stop against which, in the resting position, the spring portion is pressed.

A contact member may be used for electrically coupling a radio frequency (RF) signal circuitry of a mobile phone to one or a plurality of antennas utilized to transmit and/or receive signals at designated frequencies. A typical antenna for wireless devices, for instance a mobile phone, a smart phone, a PDA, a laptop, or an MP3 player, may be assembled in the wireless device, forming an integral part of the device. One way of contacting the antenna is by means of a spring contact. When the antenna is assembled onto a housing or a PCB of the wireless device, the mechanical interference of the contact portion of the spring with the PCB results in an elastic bias force, ensuring the electrical contact between the antenna and the connected conductor of the PCB.

Due to the proceeding miniaturization of wireless devices, contact members electrically connecting such devices are small in size, notwithstanding the required degree of movement to ensure a reliable contact. The mechanical and electrical performance of these contact members has therefore fallen off in quality to some degree.

In light of the foregoing, an objective of the present invention is to provide a contact member for an electrical connector which has an improved mechanical and electrical performance.

This problem is solved according to the present invention by a spring portion which, in the displacement position, is spaced apart from the picking platform. By the solution, fluctuations of the impedance of the electrical connector are decreased, resulting in more constant and reliable RF signals. The distance between the spring portion and the picking platform prevents the spring portion or the spring bend from abutting the holding portion, in particular, when the spring leg is deflected in displacement direction and the spring bend may bulge or arc upwards. Thus, short circuits which may arise with contact members from the prior art and may cause fluctuations of the impedance of the electrical connection are avoided.

The solution according to the invention may be combined in any way with the following further advantageous embodiments, respectively, and further improved.

According to a first advantageous embodiment of a contact member according to the invention, the spring leg may comprise a parallel section extending in parallel with the stop and abutting the stop. By this parallel section, the position of the contact portion at the resting position is clearly defined. The parallel section of the spring leg and the stop may form substantially planar faces, which are mated with each other at the resting position and, under effect of a spring force exerted by the spring portion, support the contact portion against unintended deflections when a counter-contact member is moved onto the contact member.

To generate a spring force acting on the contact portion, the spring portion may comprise a spring bend and a spring leg, which is situated between the spring bend and the contact portion.

In a further advantageous embodiment, the spring leg may comprise an inclined section, which is inclined with respect to the displacement direction. Preferably, the inclined section extends between the spring bend and the contact portion, transversally to the displacement direction and towards the holding portion. Thus, due to the inclined section, the spring bend is disposed at a distance from the holding portion.

To improve the mechanical performance of the contact member, the spring leg may comprise at least one restraining section which protrudes from the leg and overlaps the holding portion in a direction perpendicular to the displacement direction. The restraining section can pass the holding portion laterally, and against the displacement direction. The restraining section may serve to restrain the leg against lateral displacements when external forces act onto the spring leg in a direction transversally to the displacement direction. Such forces may appear when devices are not connected correctly to each other, and not in the predetermined mating direction, respectively. With regard to the contact member according to the present invention, the mating direction may correspond to the displacement direction or may be directed at least partially in the longitudinal direction of the spring portion, or of the spring leg.

In a projection direction in or against the displacement direction, the spring leg and the contact portion may project above the terminal portion. Thus, with respect to the terminal portion or the spring bend, the spring leg and the contact portion are arranged eccentrically or offset.

To further improve the electrical performance of the contact member, a centre plane of the leg and/or the contact portion can be displaced from a centre plane of a terminal portion and/or a centre plane of the spring bend. The centre planes of the leg and/or the contact portion and/or the spring bend may extend in or against displacement direction. By the displacement or offset of the centre planes, the distance between the spring leg and the holding portion, in particular perpendicular to the displacement direction, may be increased. Due to the increased distance, the risk of accidentally generated short circuits is decreased.

Preferably, the distance in displacement direction between the spring leg and the holding portion and/or the support section decreases towards the contact portion and/or increases towards the spring bend. A line of motion of the spring portion and the spring leg, respectively, which is defined when the spring leg is deflected by a mating conductor, is preferably displaced at a distance from the holding portion and the support section.

Further, to enlarge the gap between the spring leg and the support section of the holding portion, the spring leg can, at least sectionally, extend away from the support section. Alternatively of additionally, the spring leg can be provided with a recess which is located opposite the support section.

In a further advantageous embodiment of a contact member according to the present invention, the stop can be provided with a stop surface extending substantially perpendicularly to the displacement direction. Thus, the gap between the stop surface and the spring leg has the maximum possible size when the spring leg is displaced. To facilitate mounting of a contact member according to the invention, the holding portion and/or the stop surface may continue in the substantially planar picking platform. The planar picking platform can be adapted to be coupled to a vacuum picker. Preferably, the picking platform can protrude perpendicularly to a mounting direction, and substantially in the direction of the spring bend. The mounting direction may correspond to the displacement direction. The spring bend is preferably, at least in mounting direction, spaced apart from the picking platform.

For mating with a vacuum picker, the picking platform may have a planar picking face pointing against the mounting direction and/or the displacement direction. Further, to decrease the risk of a fluctuation of the impedance of a short circuit, the picking platform may extend from the stop surface in a direction facing away from the contact portion.

In a further advantageous embodiment of the present invention, the spring portion can be at least partially situated between the terminal portion and the holding portion. The holding portion can extend from the terminal portion and engage behind the spring portion.

The contact member is formed from an electrically conductive material, preferably stainless steel. The contact member can be nickel plated and be provided with a gold flash. To reduce manufacturing costs, in particular for manufacturing the contact member within a large scale production, the contact member is preferably integrally formed from one piece of sheet metal. A blank may be stamped from a sheet metal and subsequently formed by bending.

As the contact member is adapted to be applied to miniature connectors, the maximum outer dimensions of the contact member may be less than 3.5 mm. The overall length of the contact member may be less than 3.5 mm, the overall width less than 1 mm and the overall height in displacement direction about 1.8 mm. The overall width of the contact portion can be about 0.5 mm.

The preload force, which acts between the spring leg and the holding portion, can be about 0.3-0.5 N. At a maximum deflection of the spring portion, the preload force or the resulting contact force can increase up to about 1 N.

The invention will be described hereinafter in greater detail an in an exemplary manner using advantageous embodiments and with reference to the drawings. The described embodiments are only possible configurations in which, however, the individual features as described above can provided independently of one another or can be omitted. In the drawings.

First of all, a contact member 1 configured according to the invention will be described with reference to FIG. 1, which shows a first embodiment of a contact member in an unmated state, at which the spring portion 3 is situated in a resting position.

Figure 1:
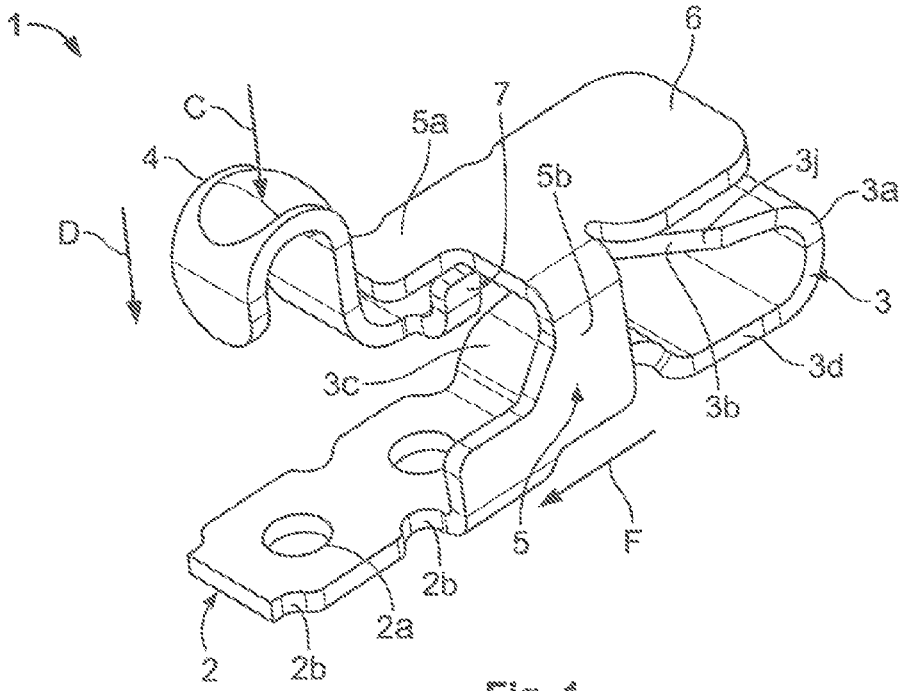
FIG. 1 is a schematic perspective view of a first exemplary embodiment of a contact member according to the invention.

The contact member 1 is made of an electrically conductive material, for example metal, preferably of one piece of sheet metal, which is stamped and bent to the shape shown in FIG. 1. The contact member 1 comprises a terminal portion 2. The terminal portion 2 is adapted to be mechanically and electrically connected to at least one conductor. The terminal portion 2 can be connected mechanically and electrically to a conductor by soldering, for example a conductor on a printed circuit board. The terminal portion 2 is shaped substantially planar and extends in a forward direction F and transversally to a displacement direction D. The terminal portion 2 is provided with openings 2*a* and recesses 2*b*, which at a soldered state of the terminal portion 2 reinforce the mechanical connection.

A spring portion 3 electrically connects the terminal portion 2 to a contact portion 4. The spring portion 3 comprises a spring bend 3*a* and a spring leg 3*b*, wherein the spring leg 3*b* is located between the spring bend 3*a* and the contact portion 4. Further, the spring portion 3 comprises a release portion 3*c* and a rest portion 3*d*. The release portion 3*c*, which is located between the terminal portion 2 and the rest portion 3*d*, serves for releasing the terminal portion 2 from bending pressures generated by the spring portion 3. The rest portion 3*d* may be supported by an underlying PCB or a housing and serve to reinforce the spring against contact forces C acting on the contact portion 4.

The contact portion 4 is supported resiliently and biased elastically by the spring portion 3. The contact portion 4 extends against displacement direction D to provide a protruding mechanical contact for a mating connector. To form a rounded contact surface, the contact portion 4 is formed from a substantially U-shaped or hook-shaped tongue of sheet metal. A bow-shaped section of the contact portion 4, which forms a convexly shaped contact face, points substantially against the displacement direction D.

The contact member 1 further comprises a holding portion 5 for biasing the spring portion 3. The holding portion 5 extends from the terminal portion 2 and clamp-like engages behind the spring portion 3. The holding portion 5 is provided with a stop 5*a*, at which the spring portion 3 abuts, and a support section 5*b*, which physically connects the stop 5*a* to the terminal portion 2. The stop 5*a* has a substantially rectangular shape, which projects in forward direction F to overlap a parallel section of the spring portion 3. The stop 5*a* serves to restrain the spring leg 3*b*, which is pressed against the stop 5*a* or biased by the stop 5*a*. The support section 5*b* extends between the stop 5*a* and the terminal portion 2 and rigidly connects the stop 5*a* to the terminal portion 2.

To enlarge the gap between the spring leg 3*b* and the support section 5*b* of the holding portion 5, the spring leg 3*b* is provided with a recess 3*j*, which is located substantially opposite the support section 5*b*.

From the stop 5*a* a substantially planar picking platform 6 protrudes substantially in the direction of the spring bend 3*a* and perpendicularly to the displacement direction D. The picking platform 6 is provided with a substantially planar picking face which faces against the displacement direction and serves to couple the miniaturized contact member 1 to a vacuum picker.

Figure 2:
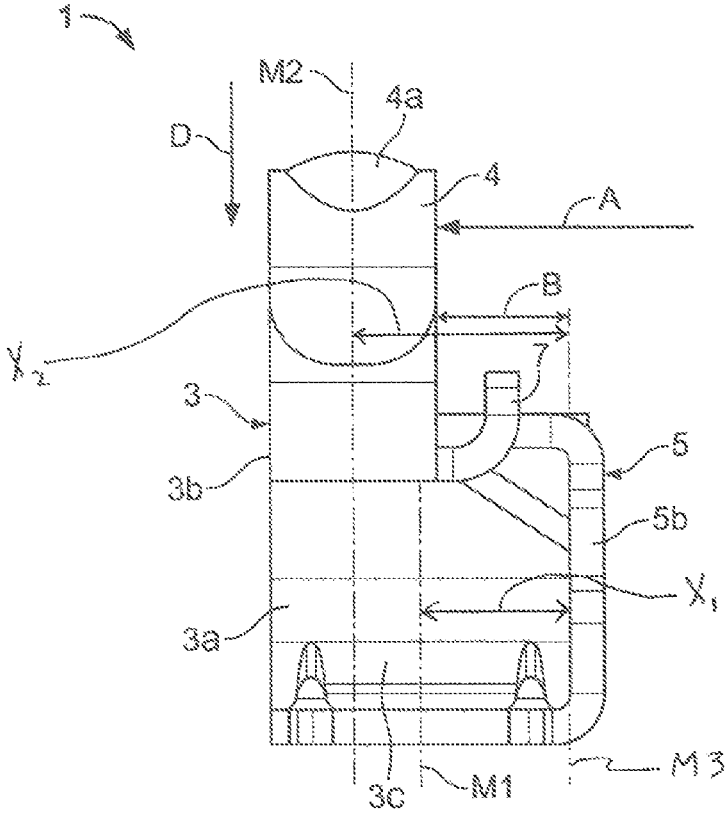
FIG. 2 is a schematic side view of the embodiment of FIG. 1.

FIG. 2 is a schematic side view of the contact member of FIG. 1, showing the contact member 1 in a perspective directed against the forward direction F.

The contact portion 4 is provided with a bulge 4*a*. The bulge 4*a* protrudes against the displacement direction D and provides a convexly rounded contact face. The bulge 4*a* protrudes from the convexly outer face of the substantially hook-shaped contact portion 4. The bulge is substantially sickle-shaped, wherein an annular point or peak of the bulge 4*a*, at a mated state, in which the contact portion 4 is situated in a displacement position, points against the displacement direction D (see FIG. 4). The support section 5*b* has a plate-like or wall-like shape which extends straight displacement direction D. The contact portion 4 is displaced with respect to the spring bend 3*a* and, at least in a direction perpendicular to the displacement direction D, spaced apart from the support section 5*b*.

The spring portion 3 has an asymmetric shape. Up to the spring leg 3*b*, the spring bend 3*a* is configured symmetrically with respect to a centre plane M1. At least a section of the spring leg 3*b* and the contact portion 4 are shaped substantially symmetrically with respect to a centre plane M2. The centre planes M1 and M2 extend in parallel and are disposed at a distance.

The asymmetric shape of the spring portion 3 and the displacement of the contact portion 4 result in an increased distance B between the contact portion 4 and the support section 5*b* or between the contact portion 4 and the holding portion 5, in a direction perpendicular to the displacement direction D. As the spring 3 is deflected in displacement direction D when the contact member is mated with a counter-contact, the distance B is kept during the deflection.

The spring portion 3 and in particular the spring leg 3*b* is provided with a restraining section 7 which protrudes from the leg and overlaps the holding portion 5 in a direction perpendicular to the displacement direction B. The retaining section 7 is substantially hook-shaped and passes the holding portion 5 and the stop 5*a* (see FIG. 1) laterally and against the displacement direction D. In case external forces deflect the spring portion 3 transversally to the displacement direction D, the restraining section 7, at least in an unmated state of the contact member, limits the maximum deflection of the spring portion 3 in a restraining direction A.

Figure 4:
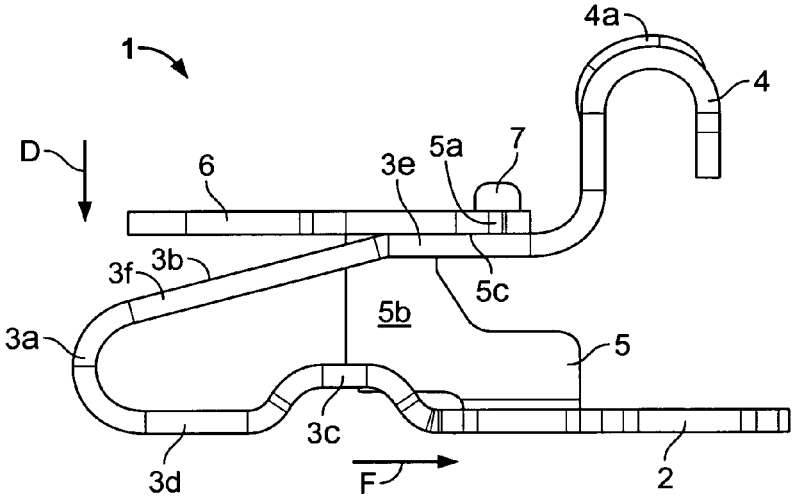
FIG. 4 is another schematic side view of the embodiment of FIGS. 1 to 3.
Figure 9:
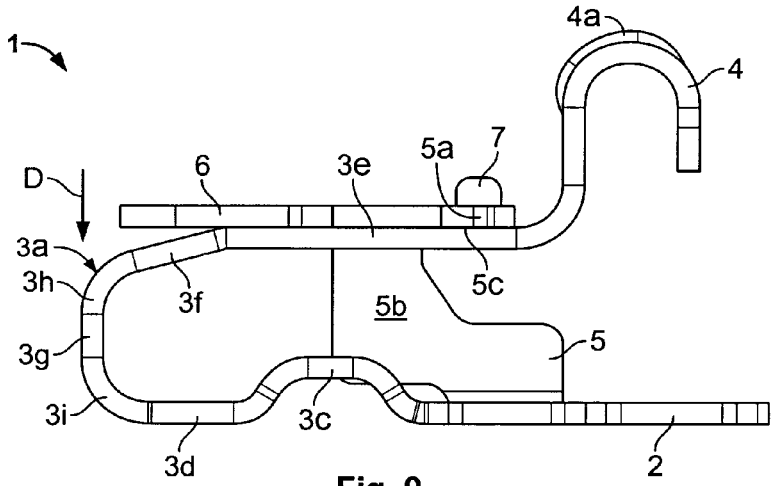
FIG. 9 is a schematic side view of the second embodiment according to FIGS. 6 to 8.
Figure 10:
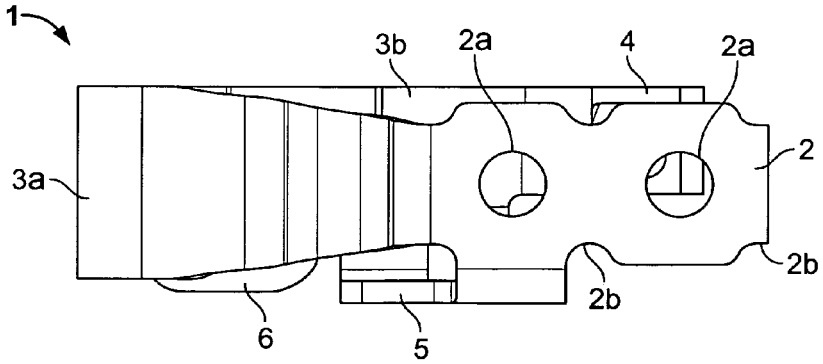
FIG. 10 is a schematic bottom view of the second embodiment according to FIGS. 6 to 9.

As shown in FIGS. 4 and 9, the wall-like support section 5*b* of the holding portion 5, which extends between the terminal portion 2 and the stop 5*a*, may also serve to restrain the spring leg 3*b*, in case the spring leg 3*b* is deflected in a direction opposing the restraining direction A.

Figure 3:
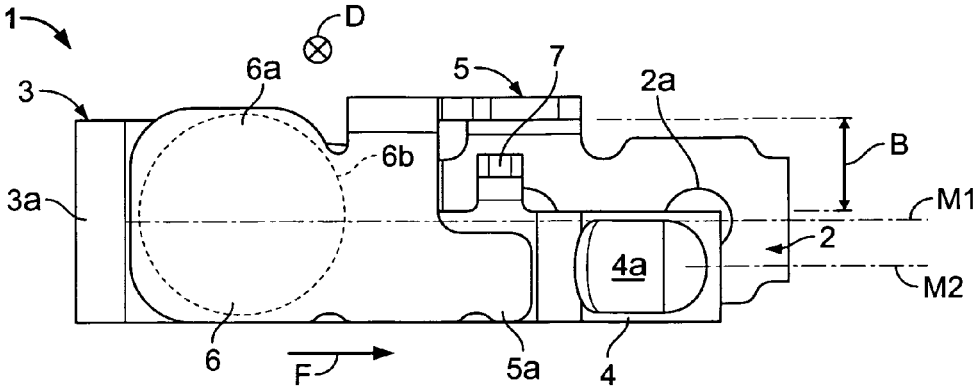
FIG. 3 is a schematic top view of the embodiment of FIGS. 1 and 2.

FIG. 3 is a top view of the first embodiment of a contact member 1 according to the invention. A centre plane M1, which extends in displacement direction D, is spaced apart from a centre plane M2 of the contact portion 4, both centre planes M1 and M2 extending in displacement direction D. Due to the displacement of the centre planes M1 and M2, the distance B between the contact portion 4 and the holding portion 5 is increased. When the contact member 1 is actuated, the contact portion 4 is moved along the centre plane M2, which continues in parallel with the support section 5*b*. Hence, the distance between the spring portion 3 and the support section 5*b* does not change when the contact member 1 is actuated. With reference again to FIG. 2, the lateral distance $X_2$ between the longitudinal centerline (M2) of the contact portion and an inner side of the support section 5*b* is greater than the lateral distance $X_1$ between the longitudinal centerline (M1) of the terminal portion and the inner side of the support section 5*b*.

The picking platform 6 faces against the displacement direction D and is substantially planar. For mating the contact member 1 with a picking device, such as a vacuum picker, the picking platform 6 comprises a planar picking face 6*a*. The picking platform 6 comprises a picking area 6*b* which is adapted to be mated with a circular pick-up head of a vacuum picker. The picking area 6*b* has a substantially circular shape for mating with the vacuum picker, which is preferably adapted to mate with a standardized vacuum picker as used for prior art contact members.

The stop is formed from a protrusion of the holding portion 5. The protrusion has a substantially rectangular shape and extends in forward direction F towards the contact portion 4. At an unmated state and in a resting position of the contact portion 4, the stop 5*a* abuts at a section of the spring portion 3 which is arranged directly beneath the stop 5*a*.

FIG. 4 is a side view of a contact member according to FIG. 1. At the resting position, the spring leg 3*b* abuts the stop 5*a*. The stop 5*a* is provided with a stop surface 5*c*, which faces the spring portion 3 in displacement direction D. Beneath the stop 5*a*, the spring leg is provided with a parallel section 3*e*, which extends in parallel to the substantially planar stop surface 5*c* of the stop 5*a*. At an unmated state of the contact member 1 or a resting position of the contact portion 4, the stop surface 5*c* abuts the parallel section 3*e* of the spring leg 3*b*. Against the forward direction F, the spring leg 3*b* passes into an inclined section 3*f*, which bridges the spring bend 3*a* and the parallel section 3*e*. In forward direction F, the distance between the inclined section 3*f* and the holding portion 5 decreases.

Figure 5:
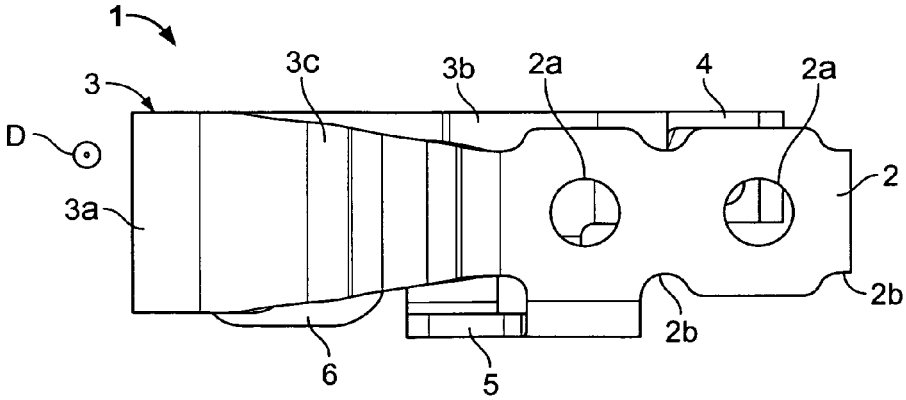
FIG. 5 is a schematic bottom view of the embodiment of FIGS. 1 to 4.

FIG. 5 is a bottom view of a contact member 1 according to the embodiment shown in FIGS. 1 to 4. The broadness of the spring portion 3 tapers from the spring bend 3*a* in the direction of the terminal portion 2. This decrease of the broadness serves, as well as the bulged form of the release portion 3*c*, to release the terminal portion 2.

In a projection direction in or against the displacement direction D, the spring leg 3*b* and the contact portion 4 project above the terminal portion 2. Thus, with respect to the terminal portion 2 or the spring bend 3*a*, the spring leg 3*b* and the contact portion 4 are arranged eccentrically or offset.

FIGS. 6 to 10 show a second embodiment of the present invention, and the same reference numerals have been used. Since most of the details illustrated therein are identical to the first embodiment, only the differences thereto will be described in more detail.

Figure 6:
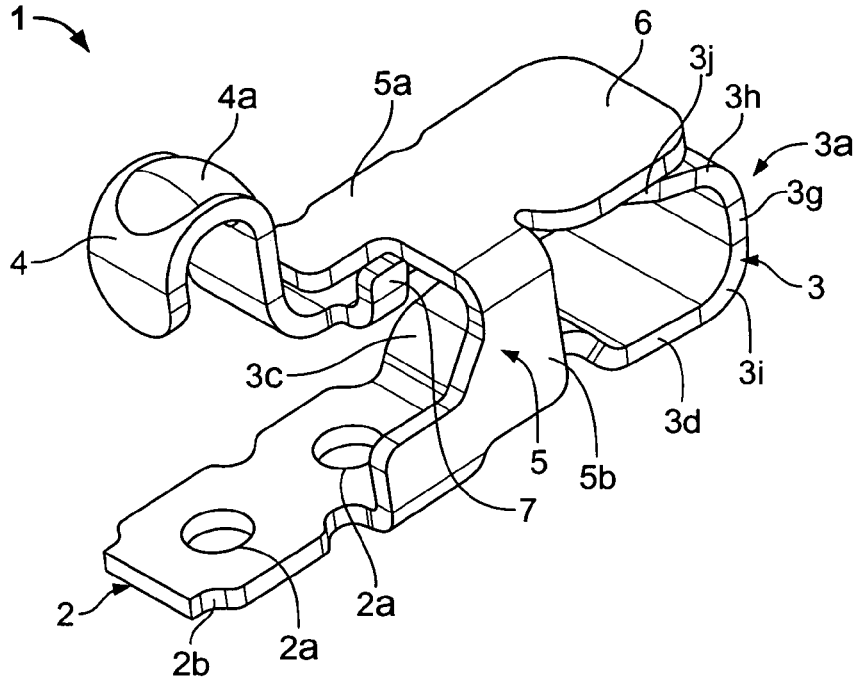
FIG. 6 is a schematic perspective view of a second embodiment of a contact member according to the present invention.
Figure 7:
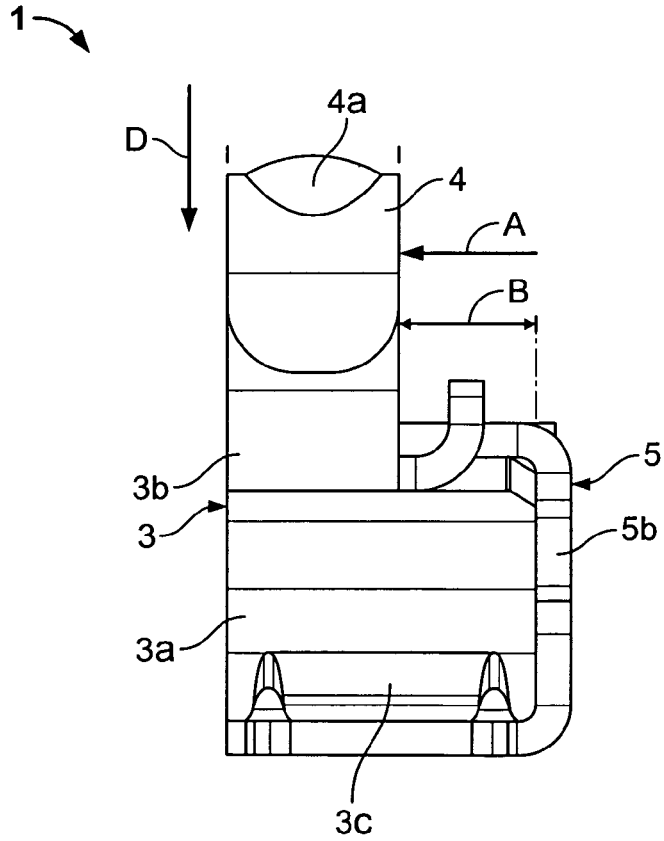
FIG. 7 is a schematic side view of the embodiment according to FIG. 6.
Figure 8:
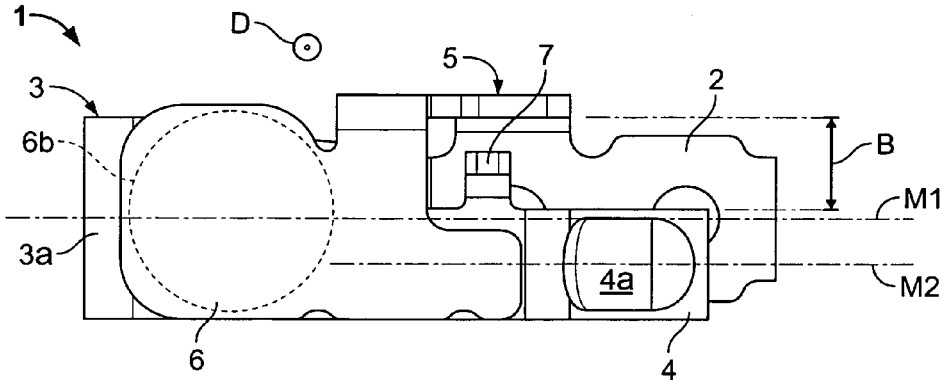
FIG. 8 is a schematic top view of the second embodiment according to FIGS. 6 and 7.

As shown in FIG. 6, the spring bend 3*a* is not shaped semi-circular, as the spring bend 3*a* of the embodiment described above. The spring bend 3*a* of the second embodiment shown in FIG. 6 comprises a linear section 3*g*, which extends in displacement direction D (see FIG. 9) and physically connects two actuated sections 3*h* and 3*i*. The linear section 3*g* increases the distance between the inclined section 3*f* and the rest portion 3*d*.

As can be seen in FIG. 9, the spring portion 3 of the second embodiment of an inventive contact member also comprises an inclined section 3*f* and a parallel section 3*e*. Compared to the parallel section 3*e* of the first embodiment, the parallel section 3*e* of the second embodiment, which continues perpendicularly to the displacement direction D, is elongated. The inclined section 3*f*, which extends between the spring bend 3*a* and the parallel section 3*e*, is shortened.

Figure 11:
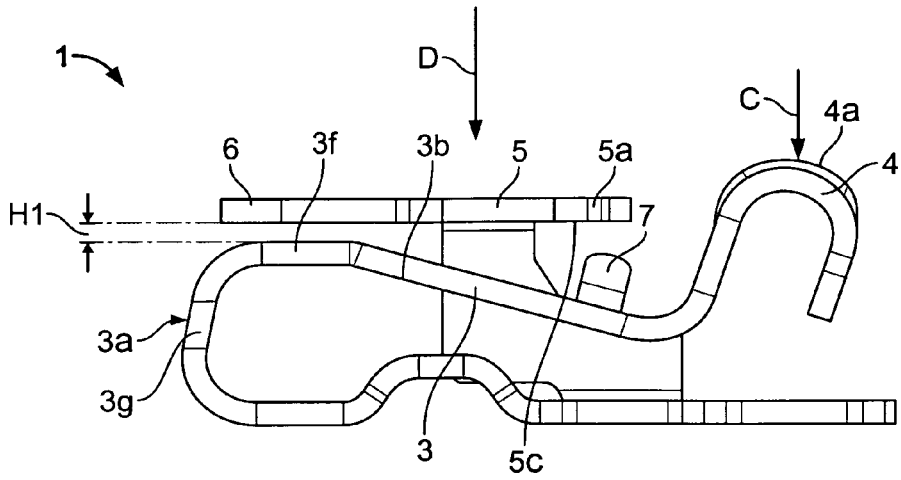
FIG. 11 is a schematic side view of a contact member according to FIG. 6 in a displacement position.

FIG. 11 shows the second embodiment of the contact member according to the invention in an displaced position or mated state. As a result of a contact force C, which is exerted onto the contact portion 4, the spring portion 3 and the contact portion 4, which is supported moveably by the spring portion, are moved in displacement direction D.

At an displaced position, the inclined section 3*f*, which extends from the spring bend 3*g* of the spring portion 3, can be arranged in parallel to the stop 5*a*, the stop surface 5*c* or the picking platform 6. Thus, a distance H1 between the spring portion 3 and the picking portion 6 or between spring leg 3*b* and the holding portion 5 is defined. Preferably, the distance between the picking platform 6 and the spring leg 3*b* is sufficiently large to improve the RF-performance and to avoid short circuits within the contact member 1.

Figure 12:
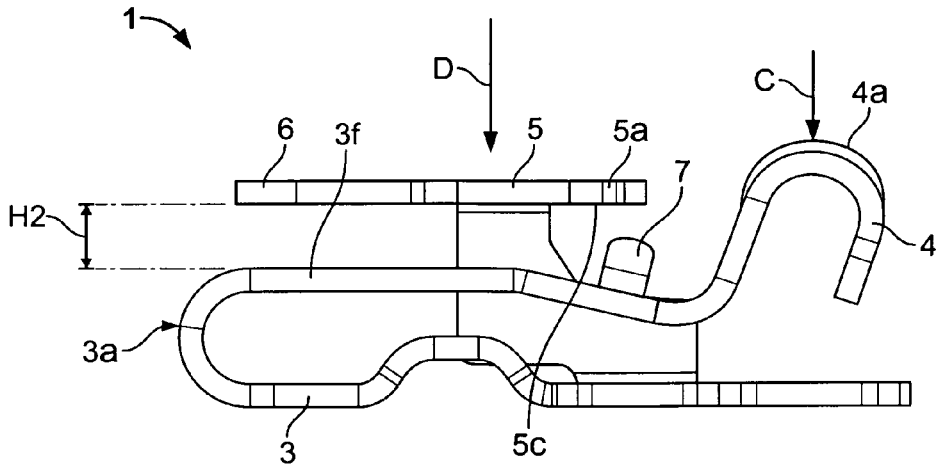
FIG. 12 is a schematic side view of a contact member according to the first embodiment of FIG. 1 in a displacement position.

FIG. 12 shows the first embodiment of a contact member according to the present invention in a displaced position. Compared to the embodiment of FIG. 11 the distance H2 between the spring portion 3 and the picking portion 6 or between the holding portion 5 and the inclined section 3*f* of the spring portion 3 is enlarged. Further, due to the smaller dimensions of the spring bend 3*a*, the distance between the spring bend 3*a* and the holding portion 5 is, at an unmated state as well as a mated state, enlarged.

The invention claimed is:

1. An electrically conductive contact member for an electrical connector, comprising:

a terminal portion adapted to be mechanically and electrically connected to at least one conductor, the terminal portion having a longitudinal centerline (M1), a contact portion adapted to contact a mating contact portion of a mating connector, the contact portion having a longitudinal centerline (M2), a spring portion that electrically connects the terminal portion to the contact portion, the contact portion being supported by the spring portion elastically displaceable from a resting position to a displacement position, and a holding portion coupled to the terminal portion that comprises a stop portion and a support section, the support section extends substantially in a displacement direction and couples the terminal portion to the stop portion, the holding portion further comprising a picking platform protruding from the stop portion substantially in the direction of a spring bend of the spring portion, and being profiled for attachment of a pick-up head, wherein the stop portion provides a stop against which, in the resting position, the spring portion is pressed, wherein the spring portion, in the displacement position, is spaced apart from the stop portion and picking platform, and wherein the lateral distance between the longitudinal centerline (M2) of the contact portion and an inner side of the support section is greater than the lateral distance between the longitudinal centerline (M1) of the terminal portion and the inner side of the support section.

2. The electrically conductive contact member according to claim 1, wherein the spring portion comprises a spring bend and a spring leg, which is situated between the spring bend and the contact portion.

3. The electrically conductive contact member according to claim 2, wherein the spring leg comprises a parallel section extending in parallel with and abutting the stop portion of the holding portion.

4. The electrically conductive contact member according to claim 2, wherein the spring leg comprises an inclined section being inclined with respect to a displacement direction.

5. The electrically conductive contact member according to claim 2, wherein the spring leg comprises at least one restraining section which protrudes from the spring leg and overlaps the holding portion in a direction perpendicular to the displacement direction.

6. The electrically conductive contact member according to claim 5, wherein the restraining section is spaced apart from the holding portion.

7. The electrically conductive contact member according to claim 2, wherein a centre plane of the spring leg and/or of the contact portion is displaced from a centre plane of the terminal portion and/or the spring bend.

8. The electrically conductive contact member according to claim 2, wherein the distance in displacement direction between the spring leg and the holding portion decreases towards the contact portion.

9. The electrically conductive contact member according to claim 2, wherein the spring leg is provided with a recess which is located opposite the support section.

10. The electrically conductive contact member according to claim 1, wherein the stop portion is provided with a stop surface extending substantially perpendicularly to a displacement direction.

11. The electrically conductive contact member according to claim 10, wherein the picking platform has a planar picking face pointing against the displacement direction.

12. The electrically conductive contact member according to claim 10, wherein the picking platform extends from the stop surface in a direction facing away from the contact portion.

13. The electrically conductive contact member according to claim 1, wherein the spring portion at least partially is situated between the terminal portion and the holding portion.

14. The electrically conductive contact member according to claim 1, wherein the contact member is integrally formed from one piece of sheet metal.

15. The electrically conductive contact member according to claim 1, wherein the picking portion extends from the stop portion and is provided with a stop surface extending substantially perpendicularly to a displacement direction, and is spaced from the spring portion.

16. The electrically conductive contact member according to claim 1, wherein the holding portion includes a support section extending upwardly from the terminal portion, the contact portion being positioned forward of the support section and the picking platform being positioned rearward of the support section.

17. The electrically conductive contact member according to claim 16, wherein the stop portion is positioned adjacent the contact portion and the spring leg comprises at least one restraining section which protrudes from the spring leg and overlaps the stop portion in a direction perpendicular to the displacement direction.

* * * * *